United States Patent [19]

Sperling et al.

[11] Patent Number: 4,896,495

[45] Date of Patent: Jan. 30, 1990

[54] WIRE TWISTING MACHINE

[75] Inventors: Eckhard U. Sperling, Toronto; Louis J. Kalmar, Richmond Hill, both of Canada

[73] Assignee: Cabletrade Industries Inc., Concord, Canada

[21] Appl. No.: 294,003

[22] Filed: Jan. 6, 1989

[30] Foreign Application Priority Data

Jan. 8, 1988 [CA] Canada ..... 556143

[51] Int. Cl.[4] ..... D07B 7/06; D07B 7/00

[52] U.S. Cl. ..... 57/127.5; 57/266; 242/58; 242/129.6

[58] Field of Search ..... 57/58.3, 58.32, 65, 57/127.5, 127.7, 266, 270; 242/58, 58.6, 129.5–130

[56] References Cited

U.S. PATENT DOCUMENTS

| | | | |
|---|---|---|---|
| 2,545,337 | 3/1951 | Blessing | 242/58 |
| 3,743,198 | 7/1973 | Lucas | 242/58.6 |
| 4,079,580 | 3/1978 | Varga | 57/127.5 |
| 4,130,985 | 12/1978 | Varga | 57/127.5 |
| 4,241,573 | 12/1980 | Halasz | 57/127.7 |
| 4,423,588 | 1/1984 | Garcia | 57/127.5 |
| 4,628,676 | 12/1986 | Lepach et al. | 57/266 |

OTHER PUBLICATIONS

M. Bonnabaud, "New Capacities of Double Twist Machines", *Wire Journal International*, Sep. 1986, pp. 118–139.

*Primary Examiner*—Donald Watkins

*Attorney, Agent, or Firm*—Bernard, Rothwell & Brown

[57] ABSTRACT

A twisting machine for use in simultaneously imparting a twist to two or more wires while coiling the twisted wires on a drum, or for imparting twist to one or more wires as they are fed from off the drum, is provided with a reel support frame, preferably having retractable pintles, by which a reel is secured in the machine. The frame has a first reeling location within the machine positioned within a circumscribing orbital wire path provided by a wire guide that rotates about the frame and reel so as to twist the wires as they are reeled. The frame is displaceable from a first in-board position within the orbit of the wire guide to a second, reel transfer position, while at standstill, in which the reel is deposited outboard beside the machine while still supported by the frame pintles or a shaft. An interlock system controls the locking, unlocking and displacement of the frame, to ensure absolute safety. During reeling operations the frame "floats" in a ballasted condition; during reel transfer operations the frame is locked to a shaft and torque arm, prior to sideways pivoting displacement of the frame, out-board, and downward canting of the frame to lower the reel onto a support surface, to permit detachment of the reel.

16 Claims, 6 Drawing Sheets

FIG.4.
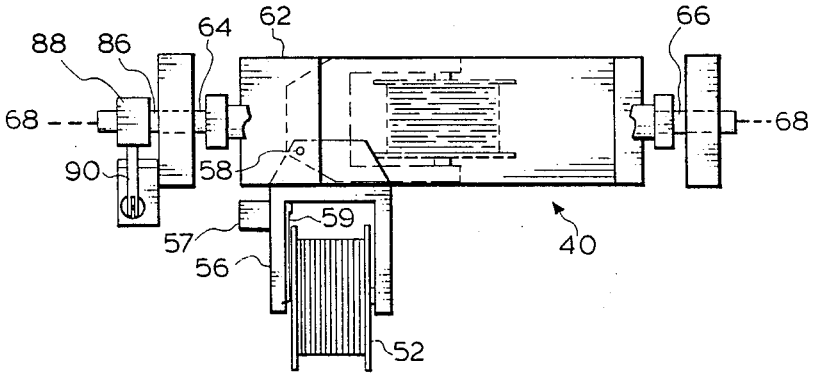
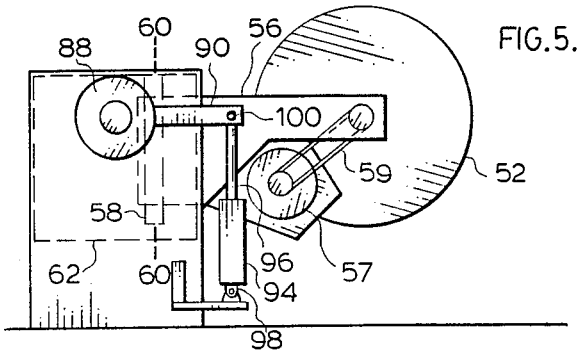
FIG.5.
FIG.6.
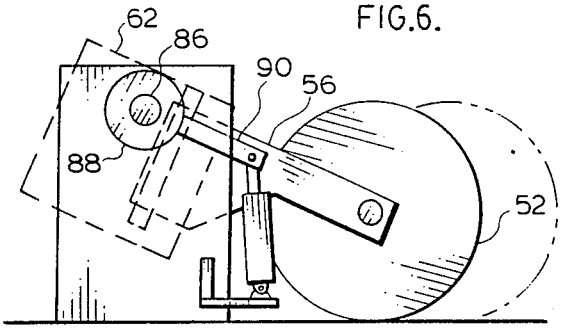

WIRE TWISTING MACHINE

FIELD OF THE INVENTION

This invention is directed to a wire handling system, and in particular to a wire twisting machine for use With cable or strand, and to the method of its use.

BACKGROUND OF THE INVENTION

Wire twisting machines are well known, being used in the manufacture of multi-strand cables of both insulated and uninsulated wires. Such machines are used, both in taking up cable on to a reel, and in paying out strands from a reel. Simultaneously, while feeding the cable or strand elements to or from the reel, a twist is imparted by guiding the cable or strand elements by way of an orbiting guide member moving in encircling relation about the reel.

Certain aspects of the prior art reeling systems are found in the following listed references:

U.S. Pat. No. 4,079,580, Mar. 1978, Varga (1)

U.S. Pat. No. 4,130,985, Dec. 1978, Varga (2)

U.S. Pat. No. 4,423,588, Jan. 1984, Garcia

WIRE JOURNAL INTERNATIONAL, Sept. 1986 "New Capacities of Double Twist Machines", by Marcel Bonnabaud, pages 118–139.

In prior art machines the handling of loaded reels, weighing as much as 5000 kilograms or more has presented significant problems, in the safe transfer thereof. In top loading machines such as VARGA (2) a crane is required to transfer the reel vertically into or from the interior of the machine. Generally in side loading machines, the reel rotational axis is coincident with the axis of spin of the orbital guide members, and the reel requires transfer bodily sideways for mounting into the pintles of the machine and removal therefrom. Such reel handling is time consuming, potentially dangerous, entails the provision of high cost, external ancilliary machines, and readily leads to damaging of the reel flanges. Furthermore, the provision of side flanges for the reel is not predicted on their requirement for lifting purposes.

SUMMARY OF THE INVENTION

The present invention provides a wire twisting system, including a wire twisting machine having a self-contained reel handling capability; and its method of use.

Thus, there is provided a wire twisting machine, and a method of loading and unloading a heavy reel into and from such a machine whilst being supported by the machine during the entire reel transfer operation.

The present invention thus provides a strand twisting machine having a polar axis; strand guide means mounted for rotation about the machine polar axis, to describe an orbit thereabout; a reel for transfer of strand product in relation thereto; reel support frame means releasably securing the reel in rotational relation therein; frame support means supporting the reel support frame means in relatively movable relation thereto, the reel support frame means being movable with the machine at standstill from a first, retracted position located within the orbit of the strand guide means, to a second, reel transfer position located out-board of the machine, for transfer of the reel.

The reel support frame means includes pintle means or a shaft releasably securing the reel in rotatable relation therein.

The subject machine includes frame actuator means connecting the reel support frame with a portion of the frame support means, for selectively and reversibly displacing the support frame between the first, in-board position and the second out-board position while supporting a loaded reel on the frame pintles or shaft, with the machine at standstill.

The machine includes rotatable shaft means secured in rotational supporting relation with the frame support means; torque arm means disconnectably attached to the shaft means, and torque arm actuator means for positioning the shaft and the support means in predetermined angular orientation, to control and vary the angle of canting of the frame support means and the reel support frame.

The subject machine further provides first safety lock means movable to a first position securing the reel support frame in the in-board reeling position, and movable to a second position to release the reel support frame for movement thereof to the second, out-board position.

The machine further includes second safety lock means having a first position maintaining the torque arm means in disconnected relation with the shaft means, to permit oscillation of the frame support means and the shaft; and a second position permitting connection of the torque arm in torque transfer relation to the shaft.

The machine further provides interlock means connecting the noted safety lock means in respective ones of their two positions, to ensure maintenance of the machine in a selected first reeling condition or a selected second reel transfer condition.

The present invention further provides the method of operating a wire reeling machine having a reel rotatably supported by a reel frame, comprising the steps of discontinuing reeling operation of the machine; at standstill deploying the reel frame outwardly from the machine to land the reel outside the machine; retracting pintle means of the reel frame in disengaged relation from the reel; removing the reel and substituting another reel therefor; engaging the substituted reel by extending the pintle means or support shaft into reel supporting relation; retracting the reel frame inwardly into the machine; locking the reel frame within the machine, and recommencing reeling operations.

In a preferred embodiment of the subject machine linear pneumatic actuators are used, both in regards to:

1. operating the respective machine component locking means in both locking and unlocking phases;
2. operating the reel frame in reel transfer relationship to a deployed out-board position for reel loading and unloading, and to a retracted in-board position within the machine for reeling activity therein;
3. locking the reel support means in secured rotational relation with the torque arm and shaft means; and
4. supporting the torque arm in shaft positioning relation, including canting of the reel support frame towards and away from the adjacent floor, to deposit one reel and pick up another reel.

In the preferred embodiment, using pneumatic actuators for the above recited actuation of the locking means in locking and unlocking relation, and in actuation of the reel frame in deploying and retracting the reel, a single piston and cylinder, double acting actuator provide the listed functions (1), (2) and (3), above. Thus the same piston and cylinder actuator serves to actuate the coupling means, coupling the shaft means to which the frame support means is secured, in coupled relation to the torque arm means. Owing to the use of a pneumatic actuator in deploying and retracting the reel, a shock absorber cushions the displacement of the reel support frame.

It will be understood that the subject reel deployment, loading and unloading and reel retraction system is applicable to use with single twist machines, with double twist machines, with machines having a direct strand take-up, and to machines employing a capstan, including multi-sheave strand feeding capstans.

In the preferred embodiment of the machine the reel support frame has attached thereto the reel drive motor, comprising an electric motor having an output pulley, and a veebelt coupled in driving relation with the reel.

In the operation of the locking/unlocking means and the deployment/retraction of the reel support frame, the subject pneumatic piston and cylinder actuator utilizes initial reaction force reacting on the actuator cylinder, in order to reposition the respective component locking and release latches and free the reel support frame from a locked retracted condition to an unlocked, deployable condition. An auxiliary latch linked to the reel support frame serves as an interlock, upon displacement of the reel support frame from its retracted position, to block any reversal of the torque arm locking means, by which the shaft, to which the reel support means is mounted, is locked to the torque arm. Thus, as the reel support frame moves to a deployed condition, the interlock precludes release of the torque arm locking means.

BRIEF DESCRIPTION OF THE DRAWINGS

Certain embodiments of the invention are described, reference being made to the accompanying drawings, wherein;

FIG. 4 is a plan view of the reel handling portion of the machine, showing the reel housing and reel in an outboard, extended position;

FIG. 5 is an end elevation view, with the reel housing and reel in the out-board, extended position;

FIG. 6 is a view similar to FIG. 5, in a reel changing position;

DETAILED DESCRIPTION OF THE INVENTION EMBODIMENTS

Figure 1:
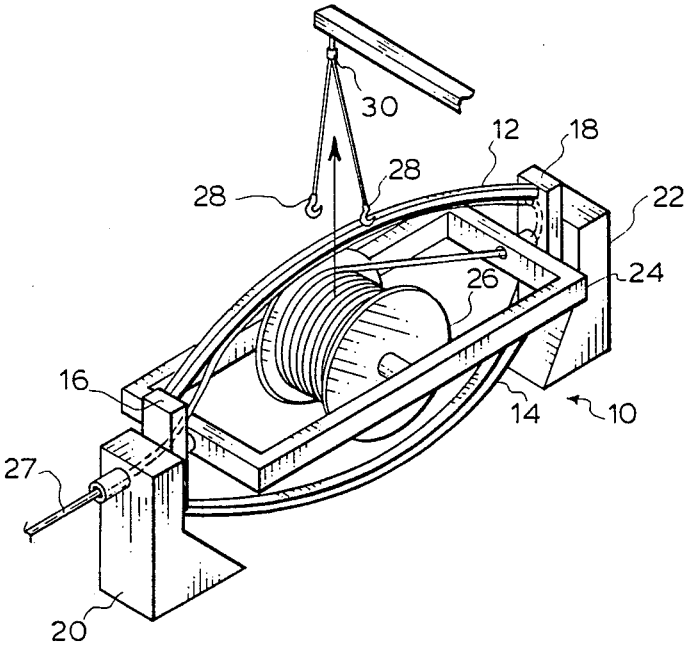
FIG.1. PRIOR ART
FIG. 1 is a PRIOR ART schematic general view of a top loading type twisting machine, and a portion of an anciliary loading/unloading crane.
Figure 2:
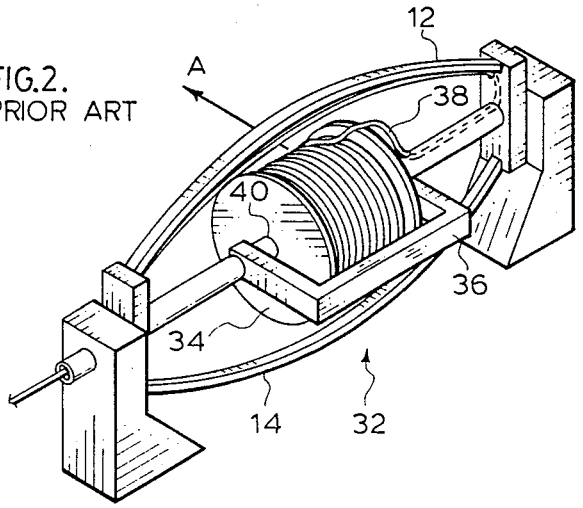
FIG.2. PRIOR ART
FIG. 2 is a PRIOR ART schematic general view of a side loading type of twisting machine, in an unloading configuration.

Before dealing with the present invention, reference is made to FIGS. 1 and 2, which illustrate prior art top loading and side loading twisting machines, requiring the use of major capacity ancilliary reel loading and unloading mechanisms, such as cranes and/or lifting platforms and the like.

In FIG. 1 the twisting machine 10 has a pair of stranding bow members 12, 14 carried by end members 16, 18, being rotatably mounted on stub shafts carried in end bearing pedestals 20, 22.

Reel frame 24, also supported by bearing pedestals 22, carries reel 26 in supported relation for rotation about a transverse axis located in the machine median plane extending at right angles to the machine polar axis. The cable 27 follows the path indicated, being twisted by rotation of the bow member 12 in circumscribed relation about reel 26, as the cable is fed longitudinally, onto a driven reel 26.

Lifting device means 28 suspended by cable 30 from an overhead gantry or crane (not detailed) lifting platform is used to move the reel 26 into and out of the machine 10.

In the case of the prior art side loading machine 32 of FIG. 2, the reel 34 thereof is mounted in reel housing 36, in coaxial relation with the polar axis of the machine 32, the cable 38 being fed over the side of reel 34, as the reel 34 is rotated by way of an inner drive shaft 40, while reel housing 36 is held stationary (floating stationary for all intents and purposes by gravity).

As shown in FIG. 2, with the strand guide members, 12, 14 in the 12-o'clock and 6-o'clock positions, and the frame 36 positioned to extend rearwardly, the reel 34 is removable and replaceable frontwardly from the machine, by way of an external lifting device, usually a lifting platform, ancilliary to machine 32, as diagramatically illustrated by the arrow A.

Figure 3:
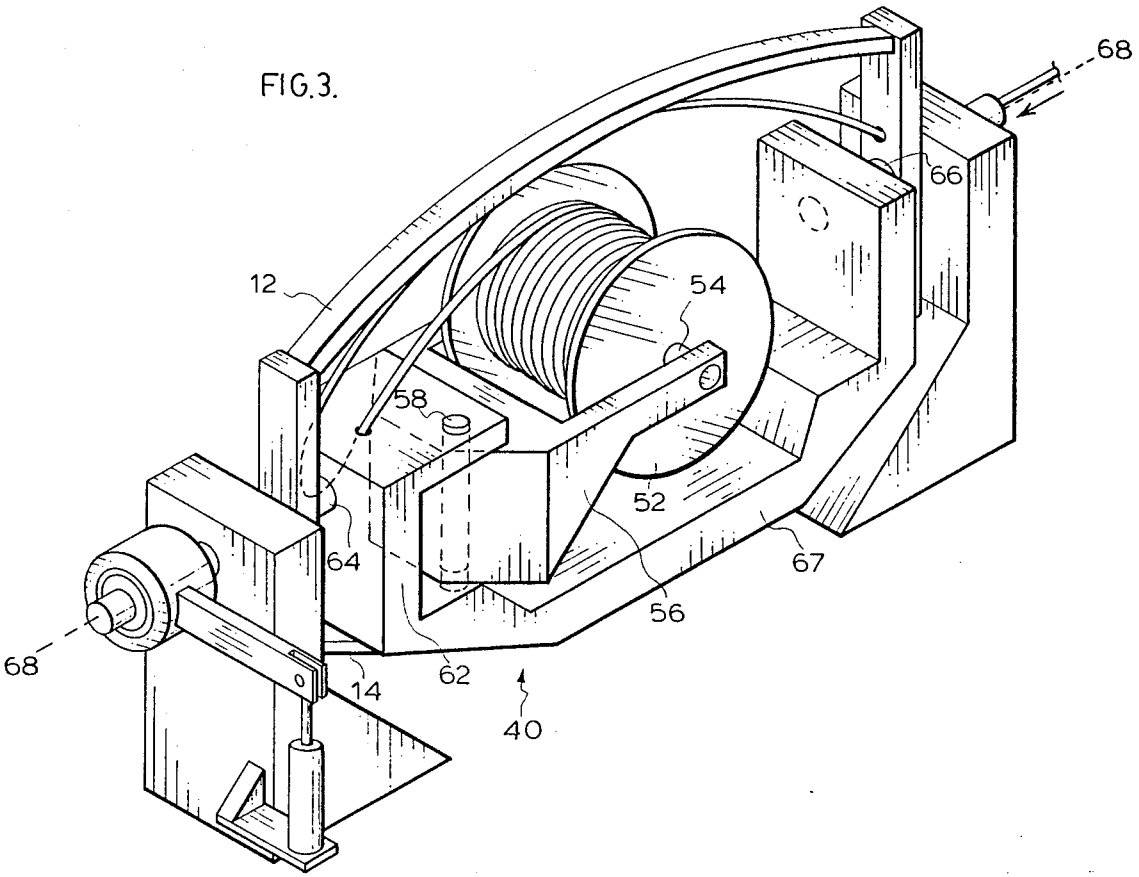
FIG. 3 is a schematic general view of a twisting machine in accordance with the present invention, in a first, running condition.

Turning to the twisting machine 40 in accordance with the present invention, as illustrated in FIGS. 3, 4 et seq., a reel 52 is rotatably mounted by axially rectractable pintles (or through shaft) 54 of reel support frame 56.

The frame 56 is pivotally mounted by way of pivot pin 58 secured to frame support means 62 for pivoting thereabout i.e. about axis 60—60 in FIG. 5.

The pivot pin 58 is secured at its ends in frame support means 62. The frame support means 62 is supported on axles 64, 66 substantially coincident with the polar axis 68 of the machine 40, for oscillation thereabout, being stabilized by counter weight 67.

The bow elements 12, 14 rotate about the polar axis 68 of the machine 40, so as to orbit the reel 52 when in an in-board reeling position.

Referring to FIGS. 4 and 5, the reel 52 and reel support frame 56 are shown in pivoted relation about pivot pin 58, being transferred horizontally outwards from the inboard position, shown in phantom in FIG. 4, to the outboard position illustrated. The frame support means 62 is supported on a shaft 86 for pivoting about axis 68.

Reel support frame 56 carries electric motor 57 connected in driving relation by vee belt 59 and reel 52.

In FIG. 6 the frame support means 62 is pivoted on shaft 86 about polar axis 68 of the machine 40, permitting the reel support frame 56 when in the out-board position to cant downwardly so that reel 52 rests on the floor or deck, adjacent the machine 40. Axial retraction of the pintles 54 then permits removal of reel 52, and reinsertion of another reel therein.

Referring also to FIGS. 7 to 10, a reel frame actuator 70 mounted on frame support means 62 has the base portion 72 mounted on a cross slide 74, and the rod end 76 of actuator 70 pivotally secured at 78 to a bracket 79 connected with the reel support frame 56.

The cross slide 74 connects with crank 76, which is pivotally mounted at 78 from frame support means 62 and is connected by pin 80 to the cross slide 74. Crank 76 has a clevis portion 82 and clevis pin 84 connected in axial positioning relation through plug 85 with splined shaft 86.

Shaft 86, which is axially extensible, connects with shaft 66, which is secured in torque transfer relation with frame support means 62. At the remote end of shaft 86 a muff coupling 88 has a torque arm 90 secured thereto. A pneumatic actuator 92 has cylinder 94 and piston 96 secured in pinned relation at 98, 100 in torque controlling relation with torque arm 90. The muff coupling is connected in torque transmitting relation with shaft 86 by toothed coupling member 102 shown axially displaced into torque transmitting relation against spring 103, to secure frame support means 62 in predetermined orientation. The actuator 92 thus controls the levelness or degree of cant of reel support frame 56, by way of the shaft 86. Reel support frame 56 connects by lever 65 to cross slide 75. On movement of frame 56 in a reel deployment mode the cross slide 75 blocks plug 85 against any untoward return motion.

Referring more particularly to FIGS. 8, 9, 10 and 11 the cross slide 74 carries pin 104 located in slot 106 of sleeve 108. Secured to cross slide 74 is actuator finger 110 which enters aperture 112 of reel support frame 56. A spring-loaded taper pin 116 connects frame support means 62 of reel frame 56 in secured position.

Figure 7:
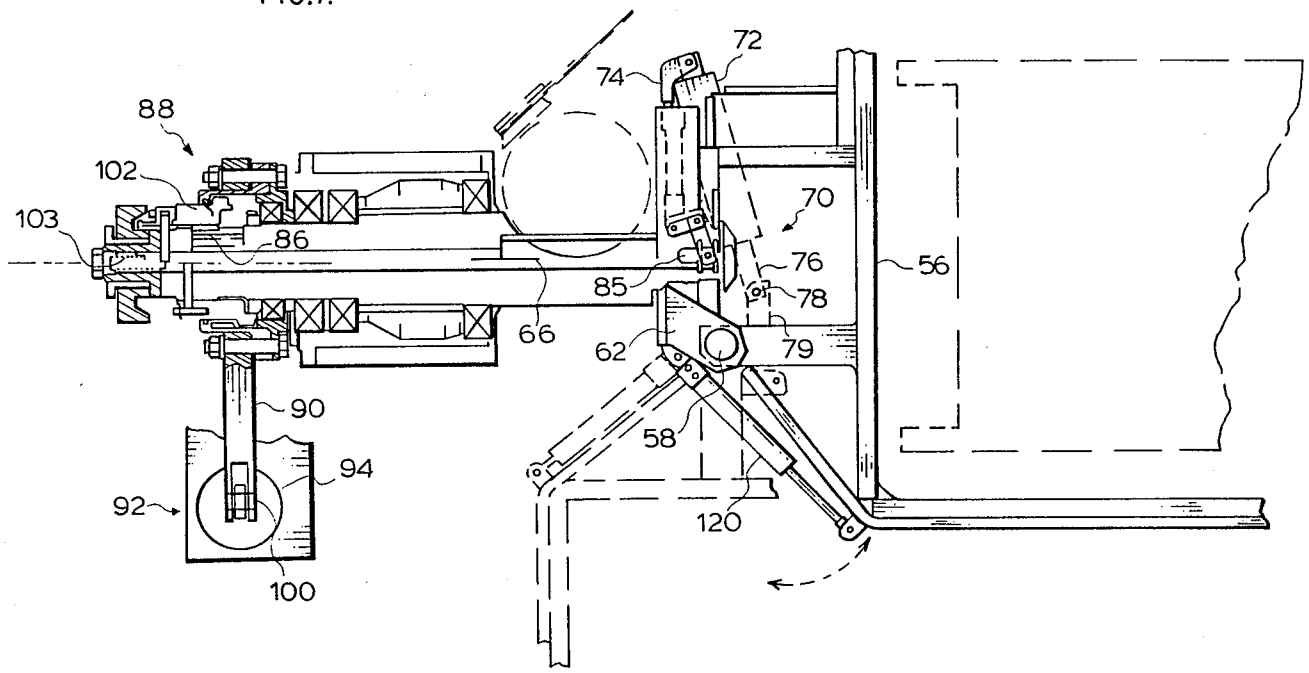
FIG. 7 is a diagrammatic plan view in partial section showing the subject reel handling portion of the apparatus.
Figure 8:
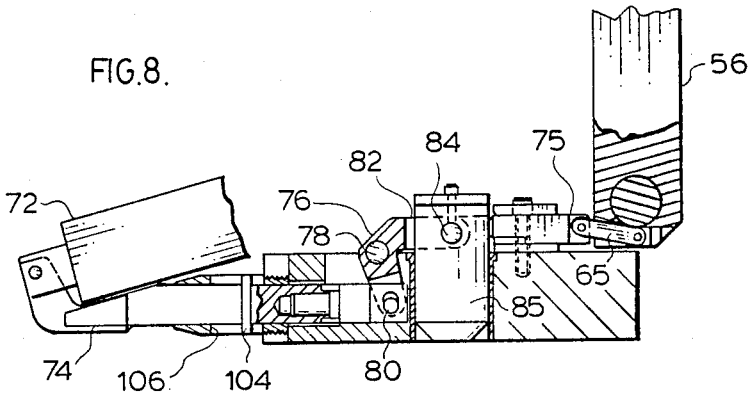
FIGS. 8, 9 and 10 are part sectioned plan views showing particulars of the reel locking/unlocking and interlocking means.
Figure 9:
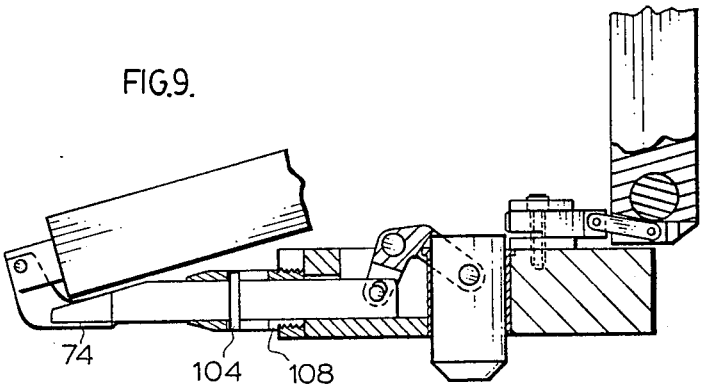
Figure 10:
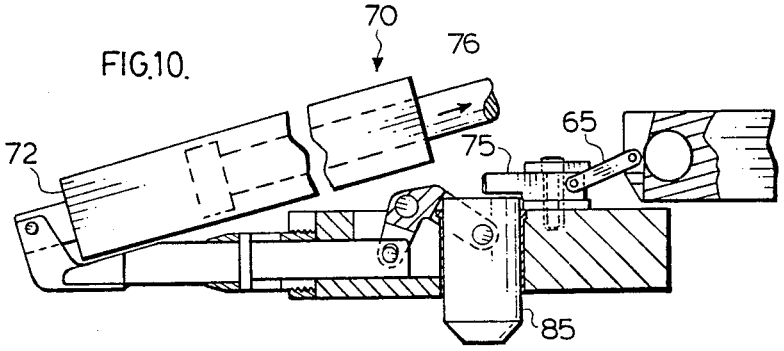
Figure 11:
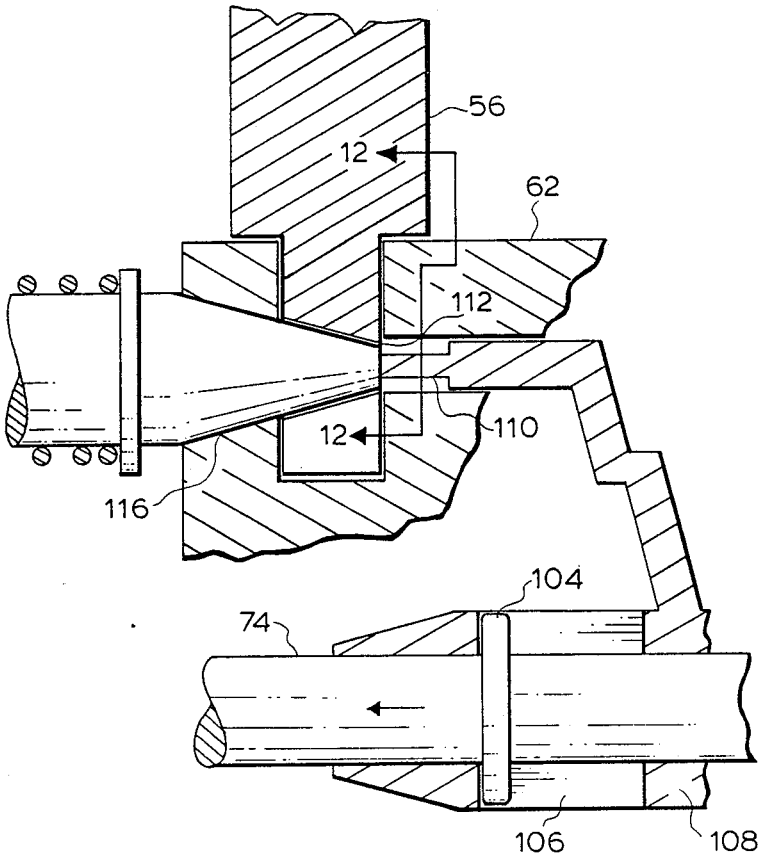
FIG. 11 is a composite view showing part of the reel support frame locking mechanism.
Figure 12:
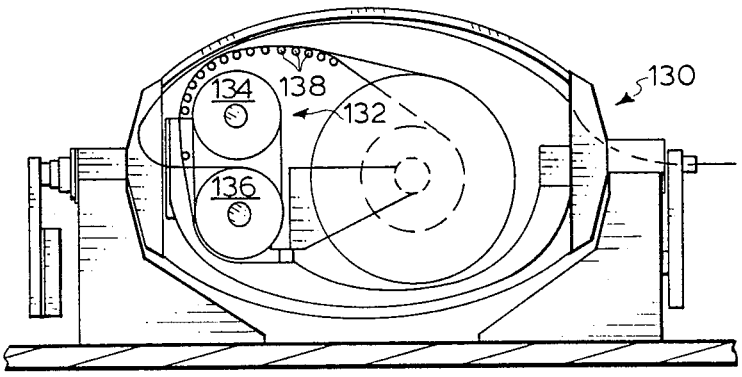
FIG. 12 is a side elevation of a machine embodiment incorporating a multi-sheave capstan.

Referring more particularly to FIGS. 7, 8 and 11, the slot 106 affords a predetermined extent of lost motion to slide 74 in moving leftward, such that crank 76 initially causes only rearward motion of plug 85, causing splined shaft 86 to engage muff coupling 88 by way of coupling member 102. The torque arm 90 and actuator 92 hold muff coupling 88 in substantially non-rotating relation, thereby holding frame support means 62 substantially immobile. Continued leftward motion of cross slide 74 then displaces sleeve 108 leftwardly, moving actuator finger 110 into aperture 112, to displace the tapered pin 116 out of engagement of reel support frame 56.

The rod end 78 of actuator 70, (See FIG. 7) acting on bracket 79 of the reel support frame 56 commences pivotal movement of the frame 56 about its pivot 58.

The displacement of reel support frame 56 in both the deployment movement (outwardly) and on retraction to an in-board reeling position is controlled by shock absorber 120.

When the actuator is pressurized, the tapered pin 116 unlocks and actuator 70 is then free to swing the reel frame 56 outwardly to the out-board position, whereby, in the illustrated embodiment the reel polar axis extends substantially parallel with the machine polar axis 68. In this condition, the motion of reel frame 56 is controlled and damped by shock absorber 120.

In general, the torque arm actuator 92 is extended to the extent necessary to maintain the pivot axis 60—60 of reel support frame 56, and the reel pivot pin 58, substantially vertical as seen in FIG. 5. This provides an arc of swing of reel support frame 56 in a substantially horizontal plane until the reel 52 is fully deployed as seen in FIG. 4. At that time, the actuator 92 is depressurized, so as to permit it to shorten under the torque reaction of torque arm 90, produced by the eccentric load of the deployed reel 52. The shaft 86 then rotates under the eccentric load of reel 52 and reel support frame 56, until the reel 52 makes contact with the adjacent ground or floor as shown in FIG. 6. In this condition, the pintles 54 can be retracted and the reel 52 removed.

Referring to FIG. 13 the machine 130 incorporates a capstan 132 having a multi-groove top sheave 134 and bottom sheave 136, with roller strand guide 138, which arrangement can provide the large feed forces necessary in feeding bare wires.

In operating the subject machine, in the preferred embodiment the reel frame actuator 70 is actuated by air, in the opening and the closing sense. For purposes of safety and simplicity, the air supply therefor is manually connected by the machine operator, thereby ensuring that the machine is at a stand still, such that a reel transfer operation can be safely effected. Thus the machine operator connects an air hose in actuator energizing relation.

The embodiments of the invention in which an exclusive property or privilege is claimed are defined as follows:

1. A strand twisting machine having a polar axis;
strand guide means mounted for rotation about the machine polar axis, to describe an orbit thereabout;
a reel for transfer of strand product in relation thereto;
reel support frame means releasably securing the reel in rotational relation therein;
frame support means supporting the reel support frame means in relatively movable relation thereto, the reel support frame mean being movable with the machine at standstill from a first, retracted position located within the orbit of the strand guide means to a second, reel transfer position located out-board of the machine, for transfer of the reel.

2. The twisting machine as set forth in claim 1, including actuator means connecting said reel support frame with an adjacent portion of said frame support means, for selectively and reversibly displacing the support frame between said first, in-board position and said second, outboard position while supporting a reel on said frame pintle means, while the machine is at stand still.

3. The twisting machine as set forth in claim 2, said frame support means having said reel support frame pivotally secured to the frame support means in off-centered relation, relative to the polar axis of the machine.

4. The twisting machine as set forth in claim 3, said frame support means being mounted on a supporting shaft, in torque transfer relation therewith.

5. The twisting machine as set forth in claim 4, including torque arm means connected with said supporting shaft; and actuator means connected to the torque arm means in rotational positioning relation with the supporting shaft.

6. The twisting machine as set forth in claim 5, said torque arm means being disconnectly connected with said supporting shaft, said actuator means being adjustable, to permit positioning of said shaft and said frame support means in predetermined angular orientation, to control the angle of canting of said reel support frame.

7. The twisting machine as set forth in claim 6 including first safety lock means movable to a first position securing said reel support frame in said in-board reeling position, and movable to a second position to release said reel support frame.

8. The twisting machine as set forth in claim 7, including second safety lock means having a first position maintaining said torque arm means disconnected from said supporting shaft, to permit oscillation of said frame support means with said supporting shaft; and a second position providing connection of said torque arm means in torque transfer relation to the supporting shaft.

9. The twisting machine as set forth in claim 8, including interlock means connected with said safety lock means to maintain the safety lock means in a selected said first or second position, to maintain said machine in a selected said first, reeling condition or a selected said second, reel transfer condition.

10. The twisting machine as set forth in claim 1, being a single twist machine.

11. The twisting machine as set forth in claim 1, being a double-twist machine.

12. The twisting machine as set forth in claim 1, being a direct strand take-up machine.

13. The twisting machine as set forth in claim 1, including capstan feed means for feeding a strand into the machine.

14. The machine as set forth in claim 8 having pneumatic actuator means connected in controlling relation with said reel support frame, in retracting and deploying relation therewith.

15. The machine as set forth in claim 14, said pneumatic actuator means including said torque arm actuator, comprising a longitudinally extensible piston and cylinder; the machine further including shock absorber means to control displacement of the reel between said in-board and said out-board positions.

16. The method of operating a wire reeling machine having a reel rotatably supported by a reel frame, comprising the steps of: discontinuing reeling operation of the machine; at standstill deploying the reel frame outwardly from the machine, to position the reel outside the machine; maintaining the reel in secured relation to pintle means of the reel frame; landing the reel upon a reel support surface; releasing the pintle means from the reel for movement of the reel therefrom; substituting another reel therefor, engaging the substitute reel by the pintle means; retracting the reel frame inwardly into the machine; locking the reel frame within the machine, and recommencing reeling operations.

* * * * *

UNITED STATES PATENT AND TRADEMARK OFFICE

CERTIFICATE OF CORRECTION

PATENT NO. : 4,896,495

DATED : January 30, 1990

INVENTOR(S) : Eckhard U. SPERLING and J.KALMAR

It is certified that error appears in the above-identified patent and that said Letters Patent is hereby corrected as shown below:

Column 1, line 7, "With" should be -- with --;

Column 3, line 16, "veebelt" should be -- vee-belt --.

Signed and Sealed this

Fourteenth Day of May, 1991

*Attest:*

HARRY F. MANBECK, JR.

*Attesting Officer*

*Commissioner of Patents and Trademarks*